US006547526B2

(12) United States Patent
Van Daam et al.

(10) Patent No.: US 6,547,526 B2
(45) Date of Patent: Apr. 15, 2003

(54) ARTICLE HAVING DAMPENING MEMBER INSTALLED INTO AN IMBEDDED CAVITY

(75) Inventors: Thomas J. Van Daam, Simi Valley, CA (US); Timothy J. Hosking, Thousand Oaks, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 09/898,336

(22) Filed: Jul. 3, 2001

(65) Prior Publication Data

US 2002/0122725 A1 Sep. 5, 2002

Related U.S. Application Data

(62) Division of application No. 09/799,248, filed on Mar. 5, 2001.

(51) Int. Cl.[7] ..... F01D 5/26
(52) U.S. Cl. ..... 416/190; 416/500
(58) Field of Search ..... 416/144, 190, 416/191, 192, 500; 74/574, 573 R, 573 F

(56) References Cited

U.S. PATENT DOCUMENTS 1,856,820 A * 5/1932 Robinson ..... 4116/196 R
3,773,506 A 11/1973 Larker et al.
3,881,844 A * 5/1975 Hennessey et al. ..... 4116/145
3,953,074 A * 4/1976 Cox ..... 301/5.22
4,183,456 A 1/1980 Schilling et al.
4,268,223 A * 5/1981 Anner et al. ..... 416/196 R
4,383,854 A 5/1983 Dembowski et al.
4,575,327 A 3/1986 Borchert et al.
4,581,300 A 4/1986 Hoppin, III et al.
4,582,681 A 4/1986 Asari et al.
4,699,569 A 10/1987 Gloor
4,722,668 A 2/1988 Novacek
4,726,927 A 2/1988 Morgan et al.
5,130,084 A 7/1992 Matheny et al.
5,142,936 A * 9/1992 McGale ..... 74/573 F
5,156,529 A 10/1992 Ferleger et al.
5,201,850 A 4/1993 Lenhardt et al.
5,730,584 A 3/1998 Dodd

* cited by examiner

*Primary Examiner*—Ninh Nguyen
(74) *Attorney, Agent, or Firm*—Harness Dickey & Pierce P.L.C.

(57) ABSTRACT

An article that is configured to be rotatably mounted includes an embedded hollow cavity into which at least one dampening member is inserted. The dampening member or members frictionally engage the hollow cavity such that relative movement between the dampening member or members and the hollow cavity operates to attenuate vibration that is generated when the article is rotated.

28 Claims, 11 Drawing Sheets

ARTICLE HAVING DAMPENING MEMBER INSTALLED INTO AN IMBEDDED CAVITY

CROSS-REFERENCE TO RELATED APPLICATIONS

This application is a divisional of U.S. application Ser. No. 09/799,248, filed Mar. 5, 2001 entitled "ARTICLE HAVING IMBEDDED CAVITY".

TECHNICAL FIELD

The present invention relates generally to the formation of articles with powdered materials and more particularly to an article formed with a powdered material to include a hollow cavity formed therein wherein the hollow cavity is employed to house a member for dampening vibrations in the article.

BACKGROUND OF THE INVENTION

BACKGROUND ART

Turbine disks and blades are commonly subject to high cycle fatigue failures due to high alternating stresses as a result of resonant vibration and/or fluid-structural coupled instabilities. Turbine disks are typically designed to avoid standing wave diametrical mode critical speeds within the operating speed range. High dynamic response occurs when the backward traveling diametrical mode frequency is equal to the forward speed diameteral frequency which results in a standing wave form with respect to a stationary asymmetric force field. Turbine blades are designed to avoid having any of the blade natural frequencies from being excited by the stationary nozzle forcing frequencies in the operating speed range.

In conventional turbine wheel assemblies, conventional blade dampening techniques are typically employed to reduce the fluid-structure instabilities that results from the aerodynamic forces and structural deflections. Accordingly, it is common practice to control both blade and disk vibration in the gas turbine and rocket engine industry by placing dampers between the platforms or shrouds of individual dovetail or fir tree anchored blades. Such blade dampers are designed to control vibration through a non-linear friction force during relative motion of adjacent blades due to tangential, axial or torsional vibration modes. Blade dampers, in addition to the blade attachments, also provide friction dampening during vibration in disc diametral modes.

Integrally bladed turbine disks (blisks) are becoming increasingly common in the propellant turbopumps of liquid fueled rocket engines and gas turbines. While the elimination of separate turbine blades reduces fabrication costs, the monolithic construction of integrally bladed turbine disks eliminates the beneficial vibration damping inherent in the separately bladed disk construction. Accordingly, the above-mentioned damping mechanism is not heretofore been feasible for integrally bladed turbine disks unless radial slots were machined into the disk between each blade to introduce flexibility to the blade shank. The added complexity of the slots would increase the rim load on the turbine blade and defeat some of the cost, speed and weight benefits of the blisk. Consequently, the lack of a blade attachment interface had resulted in a significant reduction in damping and can result in fluid-structure instabilities at speeds much lower than the disk critical speed and at minor blade resonances.

Other dampening mechanisms have been proposed that typically require multiple machining operations followed by the use of external fastener attachments. These machining operations tend to be rather expensive, thereby negating many of the cost advantages of the integrally-bladed turbine disk. Furthermore, there is a general desire to reduce or eliminate the use of any fasteners which, if over stressed, could possibly break loose and cause damage. Accordingly, there remains a need in the art for an improved vibration dampening mechanism that is cost-effectively integrated into an integrally-bladed turbine disk such that the dampening mechanism is housed within a cavity formed into the integrally-bladed turbine disk.

SUMMARY OF THE INVENTION

In one preferred form, the present invention provides an article. that is adapted to be rotatably mounted to a structure. The apparatus includes a body structure having a rotational axis, a discrete hollow structure and at least one dampening member. The hollow structure includes a body portion that is disposed concentrically about the rotational axis and which is substantially encased in the body structure. The at least one dampening member is disposed within the hollow structure and is configured to frictionally engage an interior surface of the hollow structure to attenuate vibration in the article when the article is rotated.

BRIEF DESCRIPTION OF THE DRAWINGS

Additional advantages and features of the present invention will become apparent from the subsequent description and the appended claims, taken in conjunction with the accompanying drawings, wherein:

DETAILED DESCRIPTION OF THE PREFERRED EMBODIMENT

Figure 1:
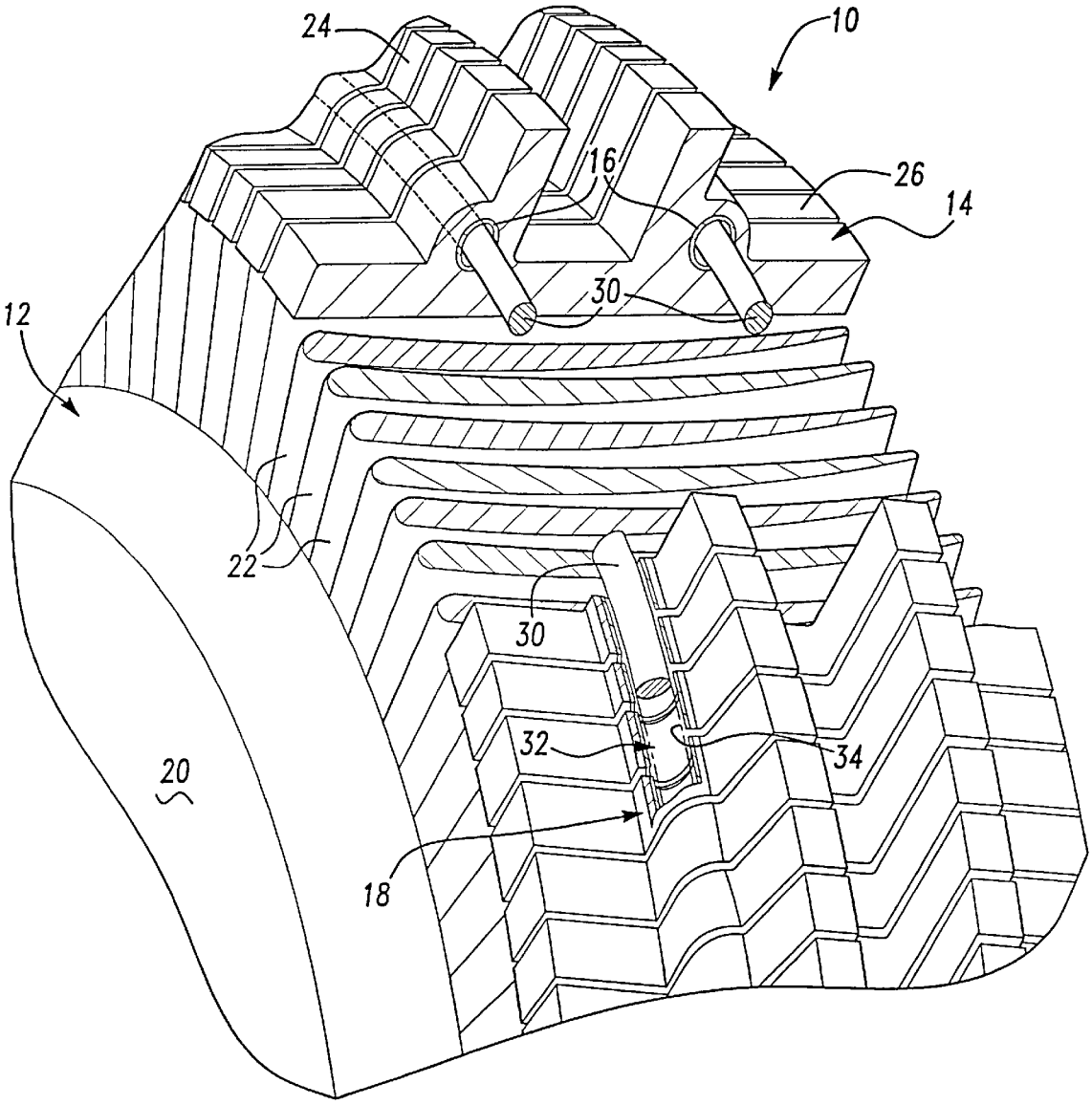
FIG. 1 is a perspective view of a portion of an integrally-bladed turbine disk constructed in accordance with the teachings of the present invention.

With reference to FIG. 1 of the drawings, an integrally-bladed turbine disk constructed in accordance with the teachings of the present invention is generally indicated by reference numeral 10. Turbine disk 10 is shown to include a preformed turbine disk or first disk portion 12, a second disk portion 14, a pair of hollow dampening channels 16 and a plurality of dampening members 18. The first disk portion 12 includes a hub portion 20 and a plurality of blades 22 that are coupled to the hub portion 20 at their proximal end. The first and second disk portions 12 and 14 cooperate to define a rim portion 24 that is coupled to the distal end of the blades 22. The rim portion 24 is cut at regular intervals to divide it into a plurality of segments 26, with each of the segments being coupled to a predetermined quantity of the blades 22. In the particular example illustrated, each of the segments 26 is coupled to one of the blades 22.

The dampening channels 16 are tubes that are disposed within the rim portion 24. In the particular embodiment illustrated, the dampening members 18 are wires 30 that are disposed within the hollow cavity 32 of the dampening channels 16. Preferably, each of the wires 30 overlaps a plurality of adjacent segments 26 and frictionally engages the inside wall 34 of its associated dampening channel 16 to absorb vibrational energy that is transmitted between the blades 22 and the rim portion 24. Those skilled in the art will understand that while the dampening members 18 are illustrated to be metallic wires 30, the dampening members 18 may, however, be fabricated from any suitable material, including a non-metallic and/or non-conductive material.

Figure 2:
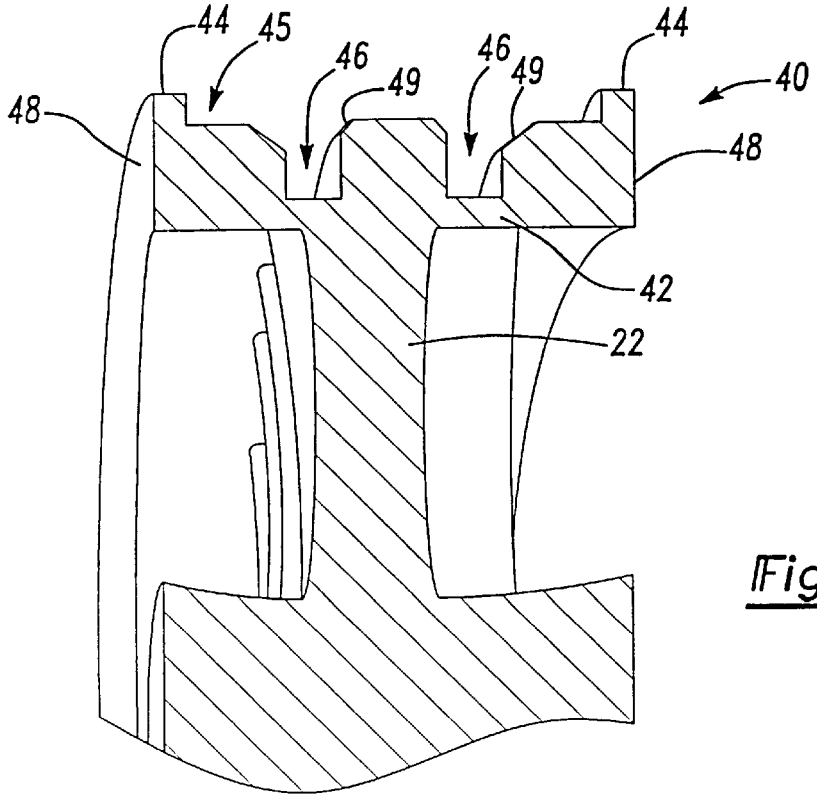
FIG. 2 is a perspective cross-section of a portion of the integrally-bladed turbine disk of FIG. 1 illustrating the first disk portion.

In FIG. 2, the first disk portion 12 is illustrated in greater detail. The first disk portion 12 may be formed through any process that may be employed to form an internally-bladed turbine disk, including forging, casting, machining or net-shape hot isostatic pressing (HIP). In the particular embodiment illustrated, the first disk portion 12 is shown to include a continuous annular flange 40 that is interconnected to all of the blades 22. The annular flange 40 includes an axially extending portion 42 that is coupled to the blades 22 at its proximal end and a pair of radially outwardly extending portions 44 that are spaced axially apart from one another and coupled to the distal surface of the axially extending portion 42. In the particular example provided, the first disk portion 12 is formed in via net-shape HIP and thereafter machined to precisely control the dimensioning of the annular flange 40.

The axially extending portion 42 and the radially outwardly extending portions 44 cooperate to define a cover pocket 45 that will be discussed in greater detail, below. A pair of dampening grooves 46 are formed into an outer portion of the axially extending portion 42 and intersect the cover pocket 45. A cross-hole 47 extends through each lateral face 48 of the annular flange 40 and intersects an associated one of the dampening grooves 46. In the particular embodiment illustrated, the dampening grooves 46 are rectangular in cross-section and have heavily chamfered sidewalls 49. Those skilled in the art will understand, however, that the cross-section of the dampening grooves 46 may be constructed in any desired manner.

Figure 3A:
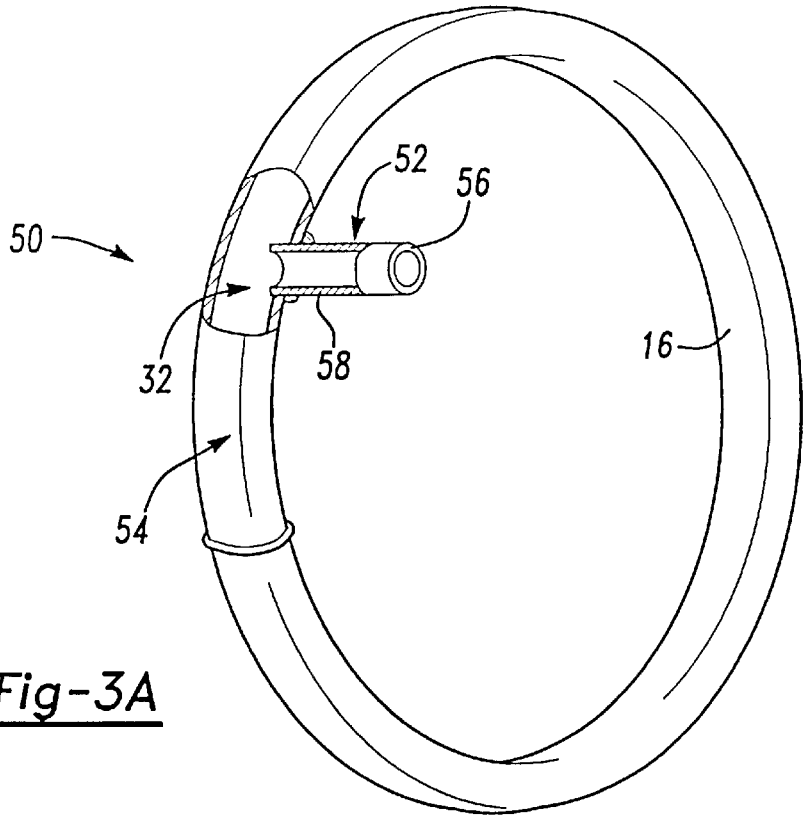
FIG. 3A is a perspective view of a portion of the integrally-bladed turbine disk of FIG. 1 illustrating the hollow structure in partial cross-section.

In FIG. 3A, a hollow structure 50 that is employed to form one of the dampening channels 16 is illustrated. In the particular embodiment provided, the hollow structure 50 includes a stem portion 52 and a body portion 54, both of which are formed from identically sized hollow cylindrical tubing.. The body portion 54 is endless, having a hollow cavity 32 of a substantially uniform cross-section over its entire length. As the body portion 54 will become the dampening channel 16, the body portion 54 is sized and shaped in a predetermined manner, which in the example provided, corresponds to a generally circular shape having a diameter that is sized to fit around the axially extending portion 42 of the annular flange 40. Those skilled in the art will understand, however, that the body portion 54 may alternatively be constructed with a different cross-section (e.g., rectangular) or to have a varying wall thickness. The stem portion 52 is fixedly coupled to the body portion 54 at its outer circumference, extending axially outwardly therefrom in a direction parallel to the axis of the body portion 54. A first end 56 of the stem portion 52 is open and the opposite end 58 intersects the body portion 54, thereby providing a flow path between the stem and body portions 52 and 54 that permits fluids to enter the hollow structure 50 through the open end 56 and travel into the hollow cavity 32 of the body portion 54.

Figure 3B:
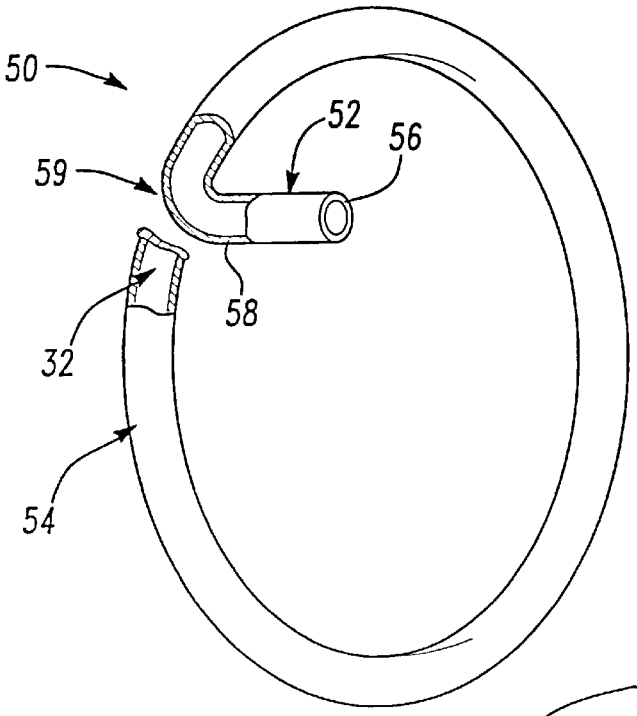
FIG. 3B is a perspective view similar to that of FIG. 3A but illustrating the end of an alternately constructed hollow structure.

The term "endless" has been used to describe the body portion 54 to emphasize that the hollow cavity 32 is substantially continuous over the entire length of the body portion 54. Those skilled in the art will understand that various design criteria for a particular application will dictate the characteristics of the body portion 54, including its shape and whether the body portion 54 is constructed in an "endless" manner or includes one or more closed ends 59 (FIG. 3B).

Referring back to FIG. 3A, the body portion 54 is shown to be formed from a single length of tubing that is first bent to a desired radius and thereafter welded together. A hole is formed through the body portion 54 and the stem portion 52 is welded to the body portion 54. Those skilled in the art will understand that any welds mentioned herein are employed to seal the joint between two structures (e.g., the joint between the stem and body portions 52 and 54) as well as to withstand the substantial forces that will be exerted onto these structures at later points in the fabrication process.

Figure 4A:
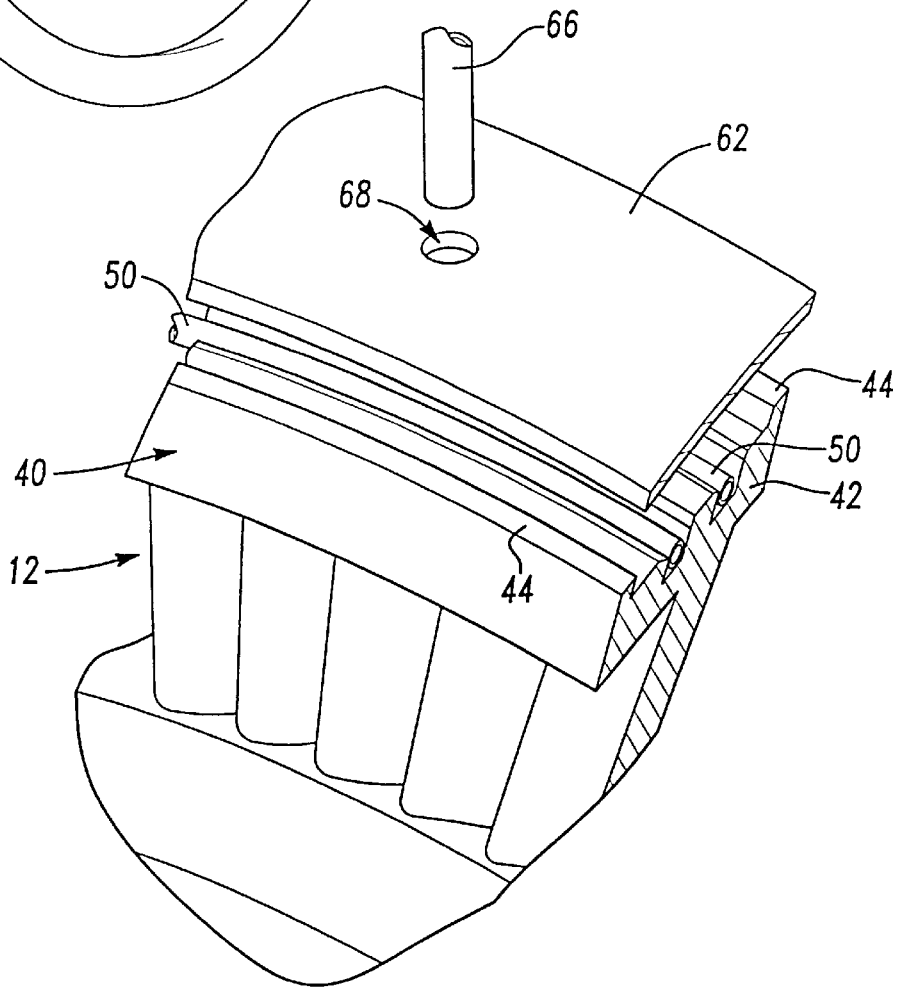
FIG. 4A is an exploded view illustrating the fabrication of the integrally bladedturbine disk of FIG. 1.
Figure 4B:
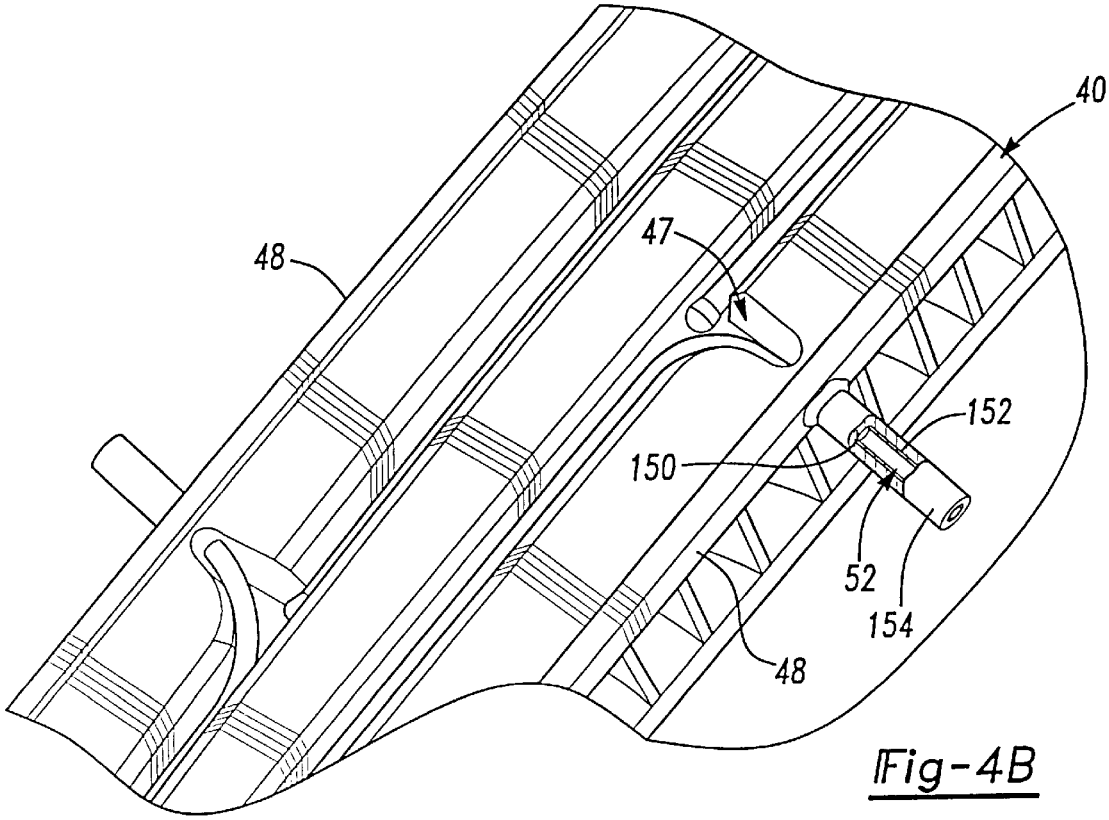
FIG. 4B is a partial top perspective view illustrating the fabrication of the integrally-bladed turbine disk of FIG. 1.
Figure 5:
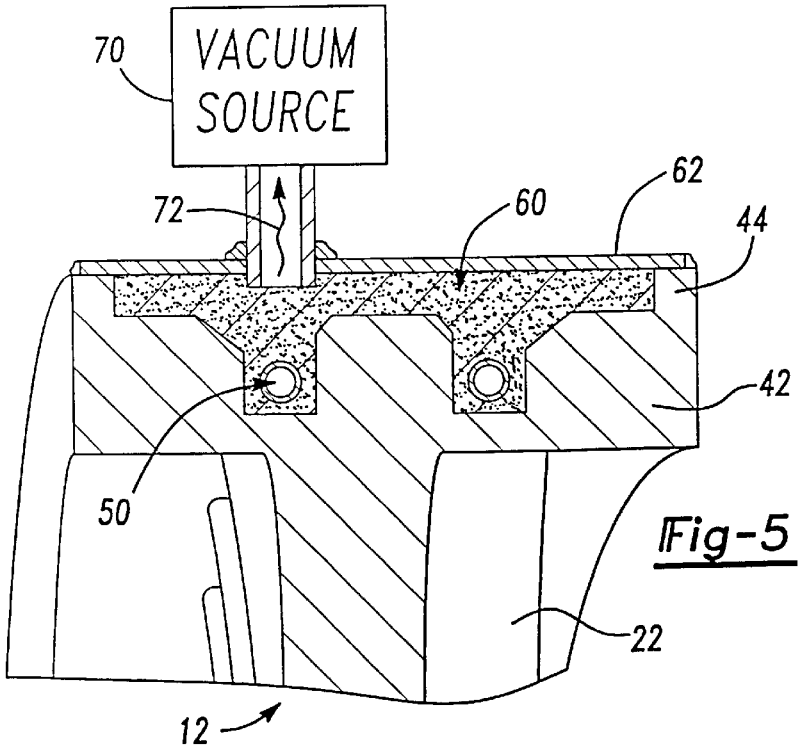
FIG. 5 is a cross-sectional view illustrating the fabrication of the integrally-bladed turbine disk of FIG. 1.

In FIGS. 4A through 5, a pair of the hollow structures 50 are shown to be fitted to the first disk portion 12 such that the body portion 54 of each of the hollow structures 50 encircles the axially extending portion 42 of the annular flange 40 so as to lie in the dampening groove 46 and abut an inward one of the sidewalls 49. Positioning of each of the hollow structures 50 in a predetermined manner (e.g., into abutment with an inward one of the sidewalls 49) may be controlled as desired by any one of numerous positioning means, including the geometry of the dampening channel (e.g., the size of the dampening groove 46, the incorporation of special protrusions or barbs that secure the hollow structure 50 within the dampening groove. 46, etc.) and mechanical fastening mechanisms, including welds, that are well known in the art and need not be discussed in detail herein.

A pair of sleeves 150, which are preferably fabricated from the same material as that of the hollow structure 50, each have an inner diameter 152 that is sized to slip fit the stem portion 52 and an outer diameter 154 that is sized relatively larger than the cross-hole 47. Each of the sleeves 150 are slipped over one of the stem portions 52 and into abutment with an associated one of the lateral faces 48 of the annular flange 40 where the sleeves 150 are welded into place. The relatively thin-walled stem portions 52 are then sealingly welded to the inside diameter 152 of one of the sleeves 150. The sleeves 150 thus prevent fluid communication through the lateral face 48 of the annular flange 40 and into an associated dampening groove 46.

A powdered material 60, which is employed to form the second disk portion 14, is packed to a predetermined density around the perimeter of the first disk portion 12 and secured in place by a sheet metal cover 62. More specifically, the cover 62 is fitted so as to lie in the cover pocket 45 and abut the inner edge of the radially outwardly extending portions 44. With the cover 62 fitted to the outer perimeter of the annular flange 40, it is then welded to the radially outwardly extending portions 44 of the annular flange 40. As the cover 62 is formed from a strip of material, the ends of the cover 62 are also welded to one another to thereby encase the powdered material 60 in a sealed cavity. The powdered material 60 may be a powdered metal, a ceramic material, or a mixture of powdered metal and ceramic materials and is preferably a material that will diffusion bond with the material that forms the first disk portion 12 during a subsequent HIP operation that will be discussed in detail below.

Alternatively, the hollow structure 50 may be configured such that the stem portion 52 extends radially outwardly from the body portion 54 and through a stem aperture (not shown) formed through the cover 62. The stem portion 52 is then welded around its perimeter to the cover 62 to fixedly secure the stem portion 52 to the cover 62 as well as to seal the joint between the stem portion 52 and the cover 62.

An evacuation tube 66 extends through an evacuation aperture 68 in the cover 62 and into the powdered material 60. A weld extends around the perimeter of the evacuation tube 66 to secure the evacuation tube 66 to the cover 62 as well as to seal the joint between the evacuation tube 66 and the cover 62. A vacuum source 70, shown in FIG. 5, is coupled to the evacuation tube 66 and employed to evacuate interstitial gases 72 from the powdered material 60. Once the interstitial gases 72 have been removed from the powdered material 60, the evacuation tube 66 is sealed (e.g., crimp welded) and the vacuum source 70 is removed.

Figure 6A:
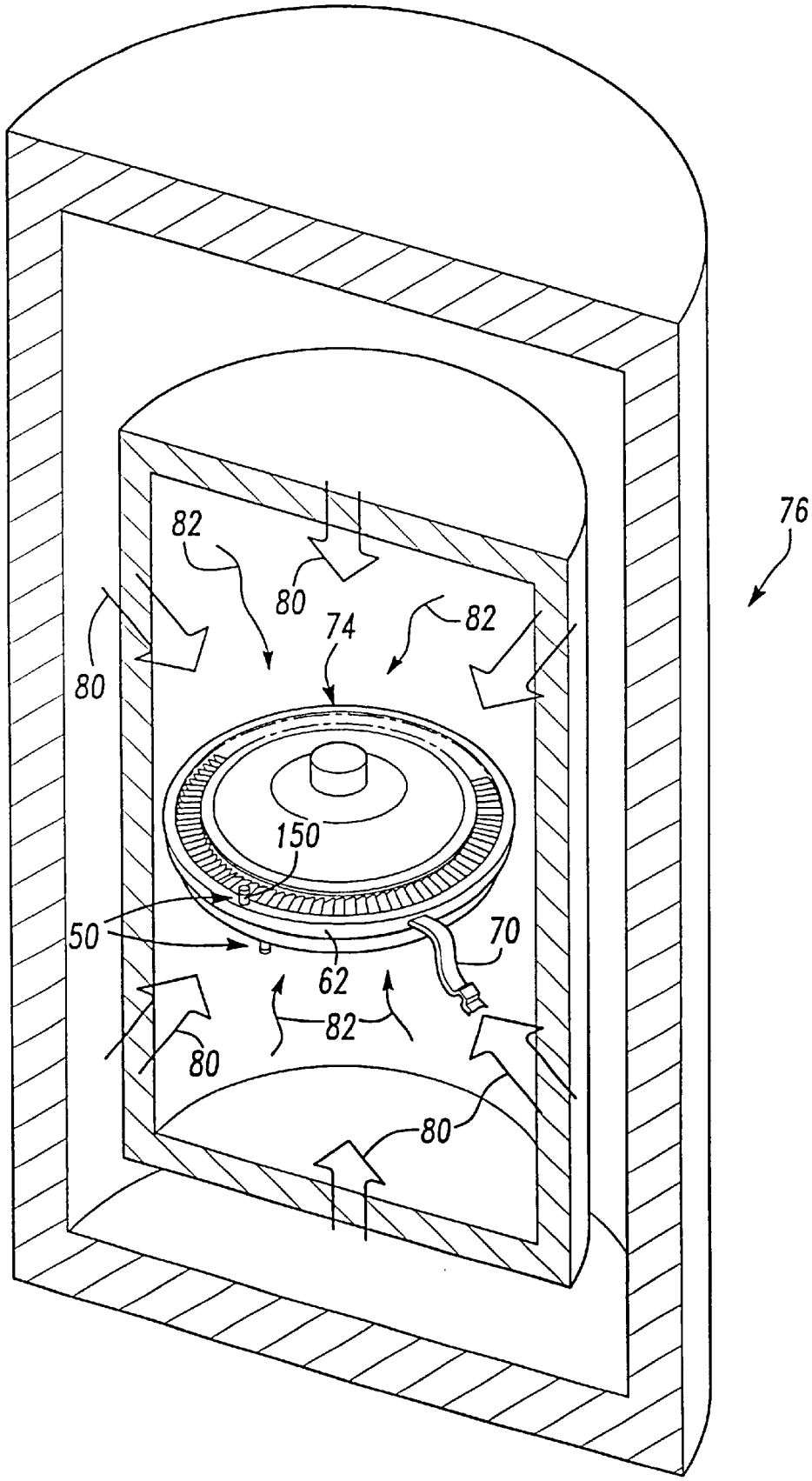
FIG. 6A is a cross-sectional view of an autoclave illustrating the fabrication of the integrally-bladed turbine disk of FIG. 1.

In FIG. 6A, the assembly 74 that consists of the first and second disk portions 12 and 14, the hollow structures 50, the powdered material 60, the cover 62 and the sealed evacuation tube 66 is placed into an autoclave 76 where the assembly 74 is subjected to a pressurized fluid 80, such as argon, nitrogen or helium, and heat 82 in a HIP operation. The heat 82 in combination with the force that is extorted by the pressurized fluid 80 through the cover 62 and onto the powdered material 60 operates to consolidate and solidify the powdered material 60. The pressurized fluid 80 enters the hollow structure 50 through the open end 56 of the stem portion 52 and also acts on the inside wall 34 of the body portion 54 to prevent the hollow cavity 32 of the body portion 54 from collapsing due to the force that is exerted by the pressurized fluid 80 onto the cover 62 and the powdered material 60.

Figure 6B:
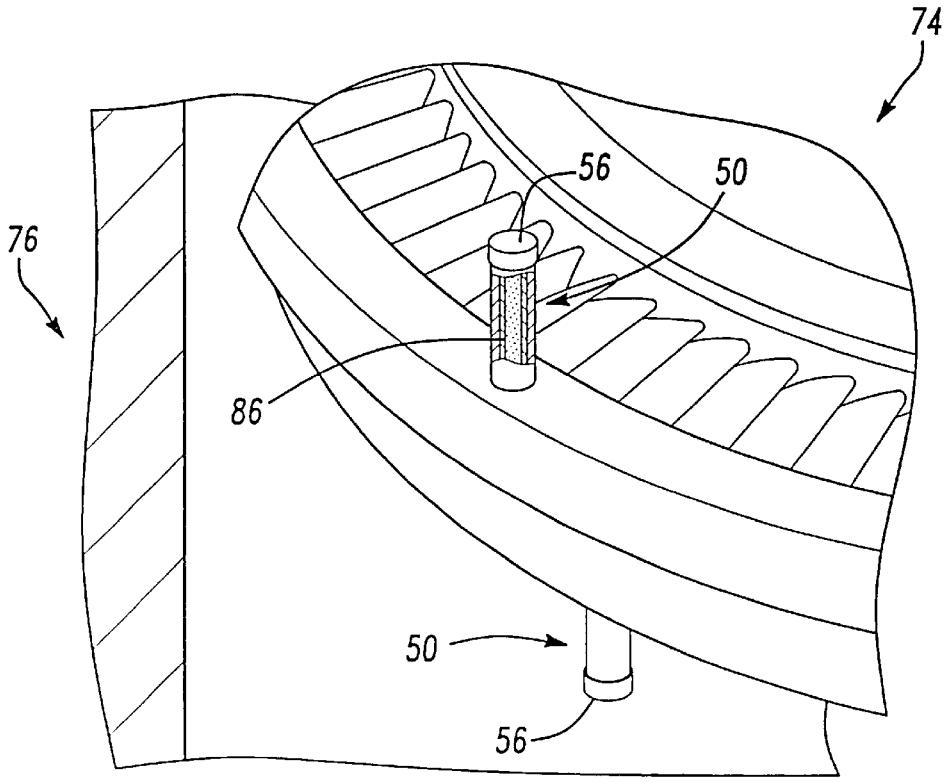
FIG. 6B is partial cross-sectional view of an autoclave similar to that of FIG. 6A but illustrating the hollow structure as filled with an incompressible fluid.
Figure 6C:
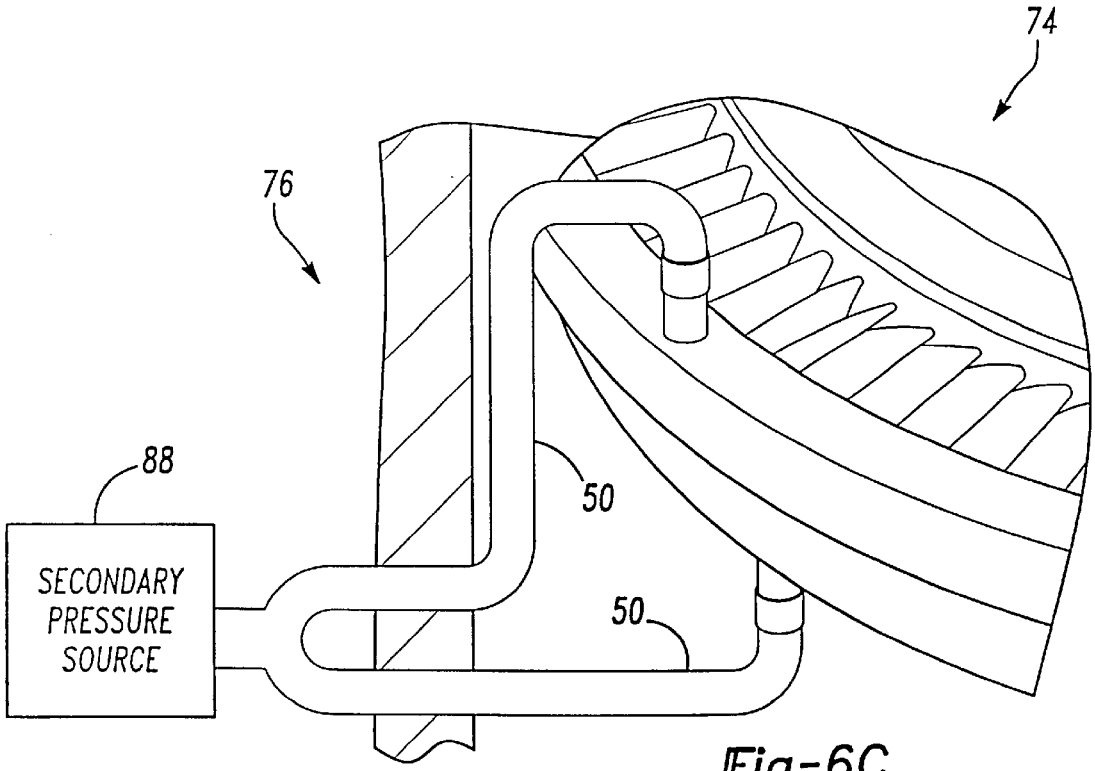
FIG. 6C is a partial cross-sectional view of an autoclave similar to that of FIG. 6A but illustrating the hollow structure as coupled to a secondary pressure source.

Those skilled in the art will understand that collapse of the hollow cavity 32 may be prevented in other ways including the filling of the hollow structure 50 with an incompressible fluid 86 or a pressurized fluid and thereafter sealing the open end 56 of the stem portion 52 prior to placing the assembly 74 in the autoclave 76 as illustrated in FIG. 6B. Alternatively, the hollow structure 50 may be coupled to a secondary pressure source 88 as illustrated in FIG. 6C. This arrangement is advantageous in that the magnitude of the pressurized fluid 80' that is delivered by the secondary pressure source 88 may be controlled independently of the magnitude of the pressurized fluid 80 that is delivered to the autoclave 76. Accordingly, the magnitude of the pressure of pressurized fluid 80' may be controlled so as to be greater than the magnitude of the pressure of pressurized fluid 80 to thereby expand the body portion 54 of the hollow structure 50 while simultaneously consolidating the powdered material 60.

Figure 7:
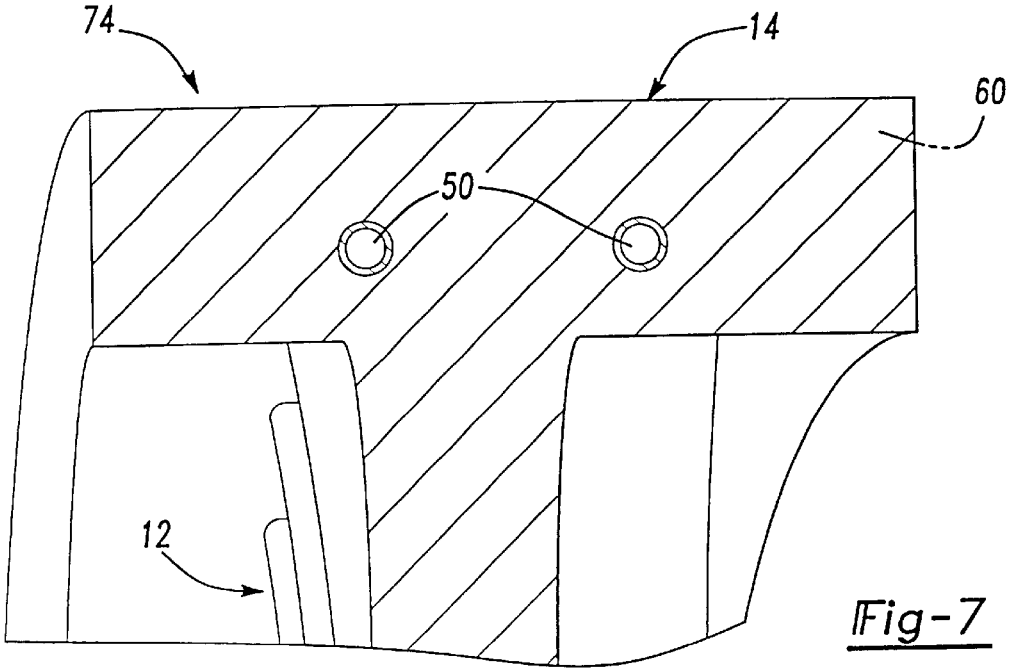
FIG. 7 is a cross-sectional view of the integrally-bladed turbine disk of FIG. 1 illustrating the rim portion after the completion of the HIP operation.
Figure 12:
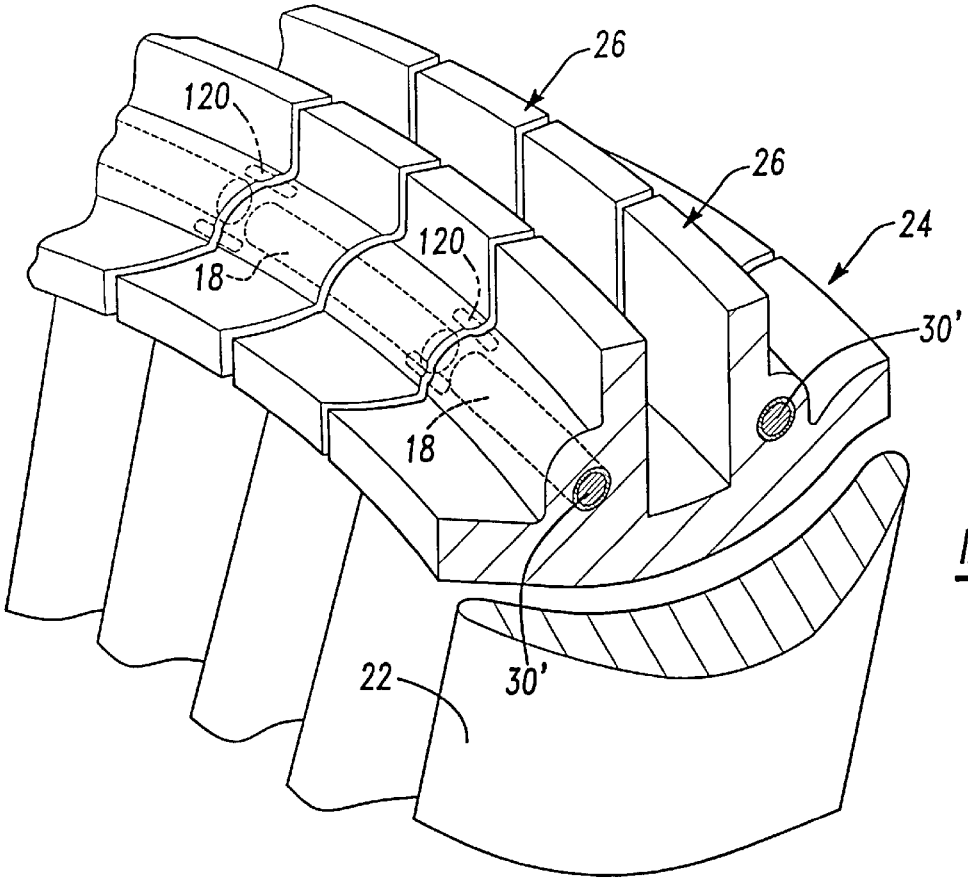
FIG. 12 is a perspective view in partial cross-section illustrating an integrally-bladed turbine disk constructed with the hollow structure of FIG. 10.
Figure 8A:
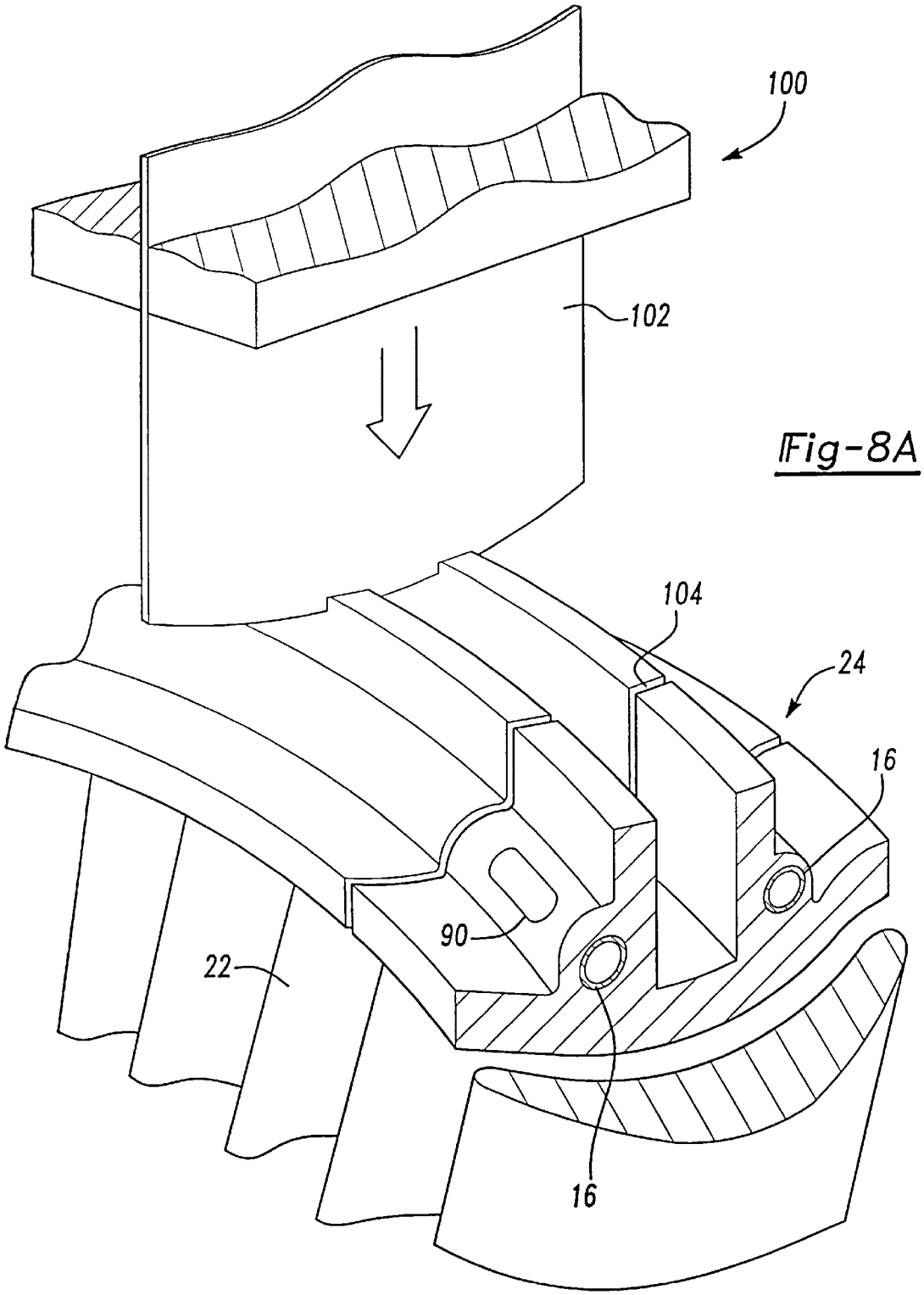
FIG. 8A is a perspective view in partial cross-section of the integrally-bladed turbine disk of FIG. 1 illustrating the severing of the rim portion into segments.

After the HIP operation is completed, the cover 62, evacuation tube 66 and sleeves 150 are removed from the assembly 74 as shown in FIG. 7. In the example provided, the powdered material 60 that was employed to form the second disk portion 14 has diffusion bonded to the first disk portion 12 and as such, the interface between the first and second disk portions 12 and 14 is imperceptible. The assembly 74 is thereafter machined as illustrated in FIG. 8A to form the rim portion 24 in a desired manner, as well as to sever a predetermined portion of the stem portion 52 from each of the hollow structures 50. Those skilled in the art will understand that the cover 62 may also be diffusion bonded to the first and second disk portions 12 and 14 and as such, the step of removing the cover 62 may be performed substantially simultaneously with the step of machining the assembly 74. In the particular example illustrated, any welds which had been employed to secure the cover 62 and the sleeve 150 to the axially extending portion 42 of the annular flange 40 are advantageously removed during the machining operation so as to minimize or eliminate the weld of heat-effected zones in the assembly 74.

The assembly 74 is placed into an electro-discharge machine (EDM) 100 and an electrode 102 that has been shaped in a predetermined manner is employed to form a cut 104 that severs the rim portion 24 at predetermined intervals to form the plurality of segments 26 discussed above. In the particular example provided, the electrode 102 is a strip of copper that has been shaped to sever the rim portion 24 such that the distance between two adjacent blades 22 along the cut 104 is equal.

Figure 9:
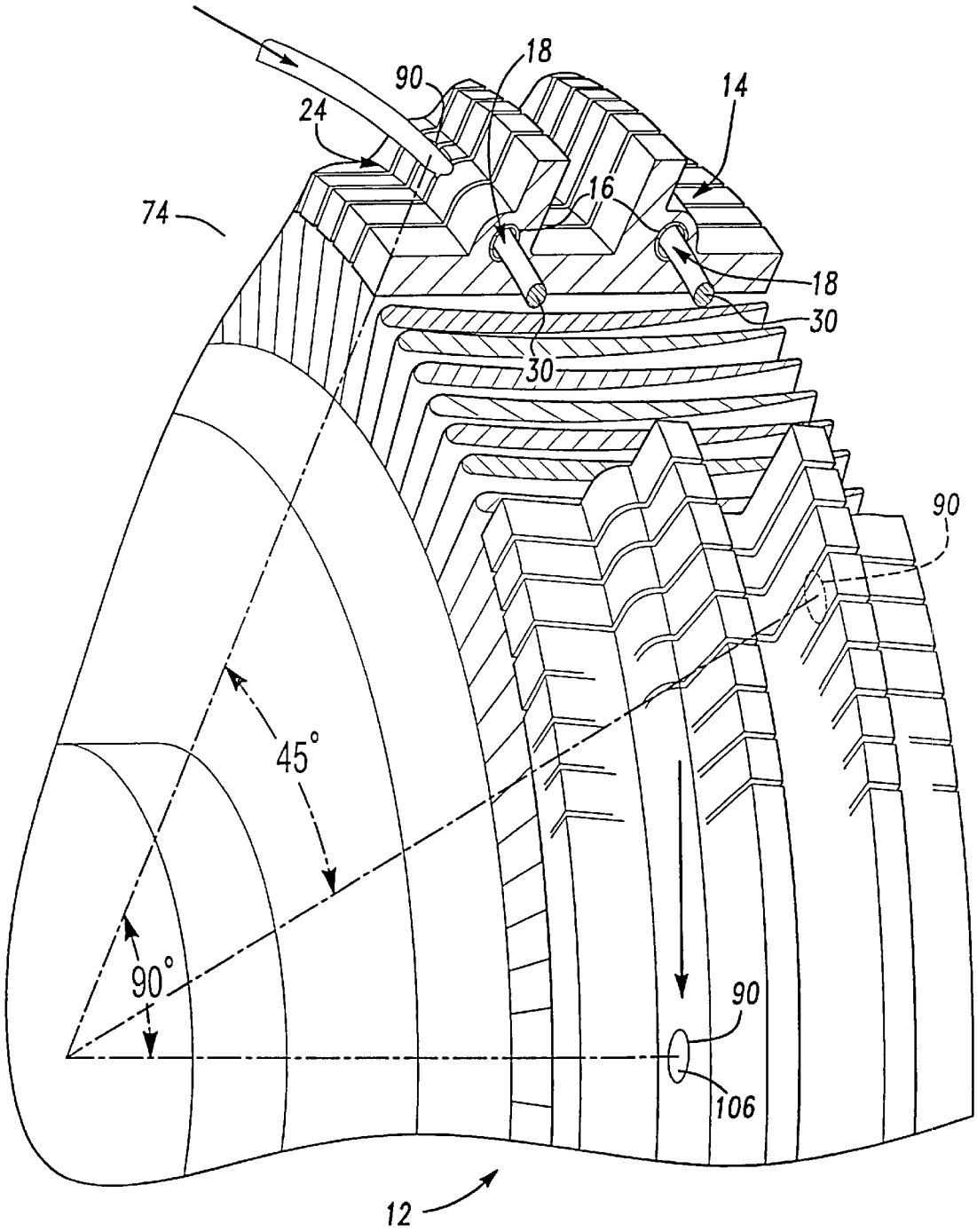
FIG. 9 is a perspective view in partial cross-section of the integrally-bladed turbine disk of FIG. 1 illustrating the insertion of the dampening members into the dampening channels.

As shown in FIG. 9, insertion holes 90 are formed into the rim portion 24 to intersect (i.e., breach) the body portion or dampening channels 16 such that the axis of the insertion hole 90 is tangent or gradually sloped relative to the dampening channel 16. In the embodiment illustrated, four insertion holes 90 intersect each of the dampening channels 16, with each of the insertion holes 90 being spaced circumferentially about the diameter of the rim portion 24 at equal intervals (i.e., spaced apart at 90° intervals). As illustrated, the insertion holes 90 that intersect one dampening channel 16 are offset from the insertion holes 90 that intersect the other one of the dampening channels 16 (i.e., in the example shown, the amount of the offset is 45°). Each insertion hole 90 is sized to receive a dampening member 18 that is inserted therethrough and into the hollow cavity 32 of the dampening channel 16. In the particular embodiment illustrated, the dampening member 18 is a wire 30 that is sized to frictionally engage the inside wall 34 of the dampening channel 16 in response to the transmission of vibrations between the blades 22 and the rim portion 24.

Figure 8B:
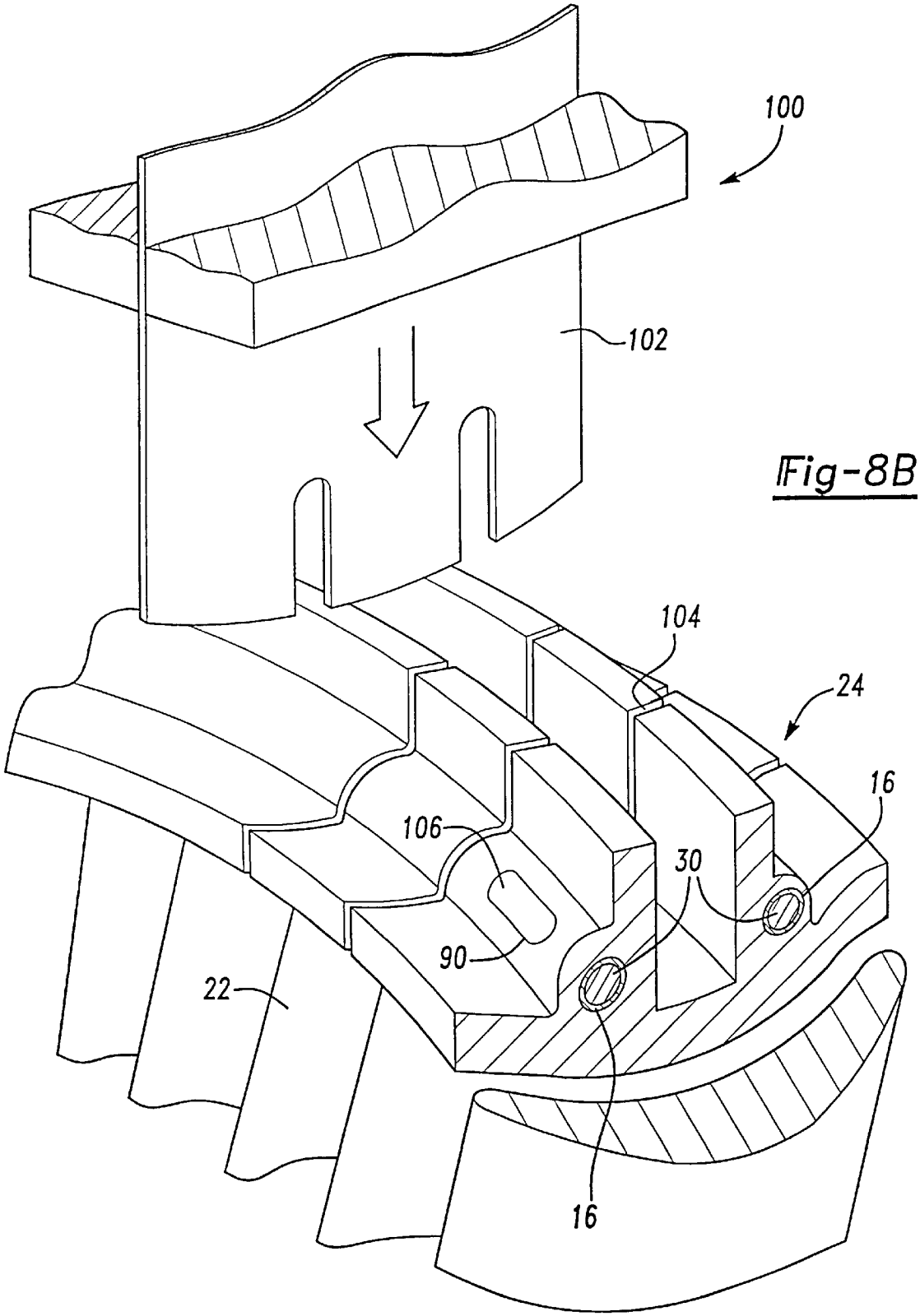
FIG. 8B is a perspective view similar to that of FIG. 8A but illustrating the severing rim portion segments and the dampening members.

Those skilled in the art will understand that the wires 30 may alternatively be installed prior to the cutting of the rim portion 24 via the electrode 102 as illustrated in FIG. 8B.

The electrode 102 may then be controlled to cut around the wires 30 while severing the rim portion 24 or may alternatively be controlled to cut the wires 30 into wire pieces 30' when the rim portion 24 is severed. Depending upon the desired orientation of the wire pieces 30' relative to the cut 104, the wire pieces 30' be repositioned after the cut 104, as when it is desirable to have each of the wire pieces 30' extend through one of the cuts 104. In this regard, it may be beneficial to simultaneously insert the wire 30 and make the cuts 104 so that the. wire 30 can be employed to reposition each wire piece 30' after each of the cuts 104 has been made. The insertion holes 90 may be plugged, if desired, by welds 106 or via other mechanical means, including threaded plugs or staking. Unlike the other prior mentioned welds that were employed to seal a joint, the welds 106 are employed to inhibit the wire pieces 30 from being expelled from the dampening channels 16 during the operation of the integrally-bladed turbine disk 10.

Figure 10:
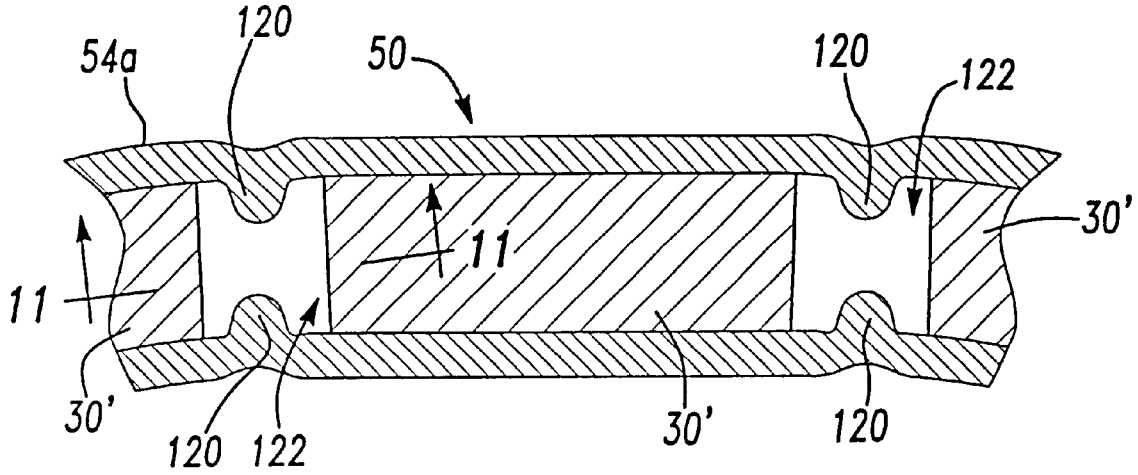
FIG. 10 is a cross-sectional view of the body portion of a hollow structure formed in accordance with the teachings of an alternate embodiment of the present invention.
Figure 11:
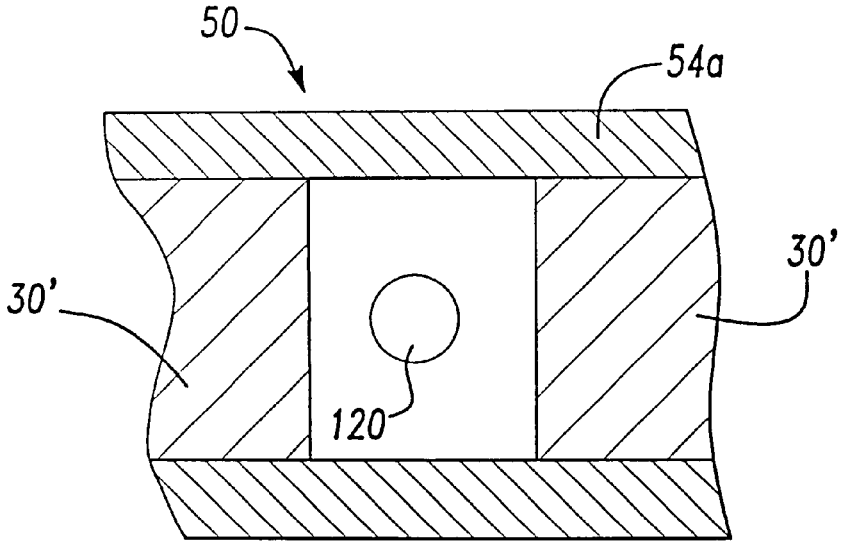
FIG. 11 is a cross-sectional view taken along the line 11—11 of FIG. 10.

While the present invention has been described thus far in a manner wherein wires 30 are inserted to the dampening channels 16 after the rim portion 24 has been fully formed, those skilled in the art will appreciate that the invention, in its broader aspects, may be constructed somewhat differently. For example, the hollow structure 50 may be formed as shown in FIGS. 10 and 11. In this arrangement, the body portion 54*a* is shown to include a plurality of crimps 120 that constrict a portion of the inside diameter of the body portion 54*a* at regular intervals. The crimps 120 define a plurality of cells 122 into which is received a dampening member 18, such as a wire piece 30'. As illustrated, the crimps 120 do not completely close off the cells 122, thereby permitting the pressurized fluid 80 flow around each of the dampening members 18 and into all of the cells 122. In the embodiment illustrated, the body portion 54*a* is positioned in the manner described above and also rotated about the perimeter of the first disk portion 12 such that each of the crimps 120 is positioned between a pair of blades 22 in the area where the cut 104 will be made to form the segments 26 in the rim portion 24. As mentioned above, the electrode 102 may then be controlled to cut around the wires 30 while severing the rim portion 24 or may alternatively be controlled to cut the wires 30 into wire pieces 30' when the rim portion 24 is severed. Construction in this manner is advantageous in that it eliminates the subsequent step of inserting the wires 30 into the dampening channel 16 and provides each segment 26 with its own dampening member 18.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the foregoing description and the appended claims.

What is claimed is:

1. An article that is adapted to be rotatably mounted to a structure, the article comprising:

a body structure having a rotational axis;

a discrete hollow structure having a body portion, the body portion being disposed concentrically about the rotational axis and substantially encased in the body structure; and at least one dampening member disposed within the hollow structure and configured to frictionally engage an interior surface of the hollow structure to attenuate vibration in the article when the article is rotated.

2. The article of claim 1, wherein a plurality of slots intersect the body structure and form a plurality of circumferentially extending segments through which the hollow structure is disposed.

3. The article of claim 2, wherein the slots extend through the hollow structure.

4. The article of claim 3, wherein the slots extend through the at least one dampening member.

5. The article of claim 2, wherein each of the dampening members extends between an adjacent pair of the slots.

6. The article of claim 1, wherein the body structure includes a first portion and a second portion, the first portion including at least two abutting walls against which at least a portion of the hollow structure is abutted, the second portion being disposed around the hollow structure and joined with the first portion.

7. The article of claim 6, wherein the second portion is diffusion bonded to the first portion.

8. The article of claim 1, wherein the hollow structure includes a stem portion that is coupled to the body portion and which extends through an outer surface of the body structure.

9. The article of claim 8, wherein the body portion of the hollow structure is endless.

10. The article of claim 1, wherein the at least one dampening member is a metallic wire.

11. The article of claim 1, wherein the at least one dampening member is inserted into the hollow structure before the hollow structure is encased in the body structure.

12. The article of claim 11, wherein at least a portion of the hollow structure is segregated into a plurality of cells, each of the cells including one of the dampening members.

13. The article of claim 12, wherein each of the cells is formed by at least two spaced apart crimps formed into the hollow structure.

14. The article of claim 1, wherein the at least one dampening member is inserted into the hollow structure through a hole formed through the body structure.

15. The article of claim 14, wherein the hole is oriented tangent to a portion of the hollow structure.

16. An article that is adapted to be rotatably mounted to a structure, the article comprising:

a first body structure formed from a first material and having a rotational axis;

a discrete hollow structure having a body portion that is disposed concentrically about the rotational axis;

a second body structure formed from the first material, the second body structure substantially encasing the body portion of the hollow structure and being diffusion bonded to the first body structure in a hot isostatic pressing operation; and at least one dampening member disposed within the hollow structure and configured to frictionally engage an inner surface of the hollow structure to attenuate vibration in the article that is generated when the article is rotated.

17. The article of claim 16, wherein a plurality of slots intersect at least one of the first and second body structures and form a plurality of circumferentially extending segments through which the hollow structure is disposed.

18. The article of claim 17, wherein the slots extend through the hollow structure.

19. The article of claim 18, wherein the slots extend through the at least one dampening member.

20. The article of claim 17, wherein each of the dampening members extends between an adjacent pair of the slots.

21. The article of claim 16, wherein the hollow structure includes a stem portion that is coupled to the body portion and which extends through an outer surface of the body structure.

22. The article of claim 21, wherein the body portion of the hollow structure is endless.

23. The article of claim 16, wherein the at least one dampening member is a metallic wire.

24. The article of claim 16, wherein the at least one dampening member is inserted into the hollow structure before the second body structure is diffusion bonded to the first body structure.

25. The article of claim 24, wherein at least a portion of the hollow structure is segregated into a plurality of cells, each of the cells including one of the dampening members.

26. The article of claim 25, wherein each of the cells is formed by at least two spaced apart crimps formed into the hollow structure.

27.. The article of claim 16, wherein the at least one dampening member is inserted into the hollow structure through a hole formed through the body structure.

28. The article of claim 27, wherein the hole is oriented tangent to a portion of the hollow structure.

* * * * *